United States Patent [19]

Marsh

[11] Patent Number: 4,649,704

[45] Date of Patent: Mar. 17, 1987

[54] SUBSEA POWER FLUID ACCUMULATOR

[75] Inventor: Gary L. Marsh, New Orleans, La.

[73] Assignee: Shell Offshore Inc., Houston, Tex.

[21] Appl. No.: 888,290

[22] Filed: Jul. 25, 1986

Related U.S. Application Data

[63] Continuation of Ser. No. 685,625, Dec. 24, 1984, abandoned.

[51] Int. Cl.[4] ..... F16D 31/02

[52] U.S. Cl. ..... 60/415; 60/413; 92/151

[58] Field of Search ..... 60/413, 415, 547.1, 60/593, 414, 416; 91/460; 92/151, 152; 138/31

[56] References Cited

U.S. PATENT DOCUMENTS

| | | | |
|---|---|---|---|
| 2,393,524 | 1/1946 | Fant | 92/151 X |
| 3,856,048 | 12/1974 | Gratzmuller | 138/31 |
| 3,918,498 | 11/1975 | Schneider | 138/31 |
| 3,987,708 | 10/1976 | Uhrich | 60/413 X |
| 4,204,461 | 5/1980 | Gratzmuller | 60/413 X |
| 4,205,594 | 6/1980 | Burke | 92/151 X |
| 4,475,710 | 10/1984 | Leupers | 60/413 X |

*Primary Examiner*—Edward K. Look

[57] ABSTRACT

The present invention is directed to a pressurized fluid accumulator adapted to be connected to a subsea valve actuator on a drilling wellhead assembly, prior to lowering the combined assembly to the ocean floor.

The apparatus of the present invention consists of a pressure compensated piston located in a first hydraulic cylinder. Movement of this piston causes pressurized hydraulic fluid to be delivered in sufficient volume to activate a subsea hydraulically-activated valve.

The first piston is connected to and driven by a second piston contained in a second hydraulic cylinder. Charging and accumulation of pressurized hydraulic fluid in the first cylinder causes a nearly absolute vacuum to be developed under the second piston. The pressure differential between this vacuum and the prevailing sea pressure is used to move the first piston during delivery of the hydraulic fluid to the actuator of the hydraulically activated valve.

10 Claims, 6 Drawing Figures

21
43
22
44
34
P
46
23
37
42
41

10
50
21
11
16
43
35A
32A
31A
22
12
44
35E
36
34
30

SUBSEA POWER FLUID ACCUMULATOR

RELATED APPLICATION

This is a continuation of application Ser. No. 685,625, filed Dec. 24, 1984, now abandoned.

BACKGROUND OF THE INVENTION

1. Field of the Invention

The apparatus and method of the present invention relate to a device used to furnish high pressure power fluid for actuation of hydraulically actuated valves or other hydraulically operated devices located beneath the surface of a body of water.

2. Description of the Prior Art

As well drilling operations progress into deeper waters in the search for new oil and gas reserves, new subsea equipment must be developed. Valves are the main flow control devices for this equipment. Since handwheel operated valves cannot easily be used below the surface of bodies of water, hydraulically actuated valves (and other pressure and flow control devices) are typically used to control the flow of oil and gas from underground reserves.

A hydraulically-actuated valve typically has a valve actuator, connected to a moveable valve gate carried within the valve body. Pressurized hydraulic fluid supplied to the valve actuator acts on one side of a moveable piston or diaphragm connected to the moveable valve gate. The force generated by this pressurized fluid causes the gate to move into an open or closed position.

This pressurized hydraulic fluid is typically generated by high pressure, low volume, positive displacement pumps. Since a large volume of hydraulic fluid is required to activate most subsea valves, and other pressure control devices, pressurized hydraulic power fluid reservoirs, or "accumulators", are used in conjunction with the low volume positive-displacement pumps. The pump will be operated for a sufficient length of time in order to supply the accumulator with the amount of pressurized fluid required to operate the valve quickly, when needed.

These accumulators usually take the form of a hollow metal spherical or cylindrical canister partially filled with a pressurized inert gas, such as nitrogen, and partially filled with a pressurized hydraulic fluid. In operation, these accumulators are initially precharged with pressurized nitrogen prior to being submerged. The precharged pressure usually is equal to the anticipated pressure of the water that will be encountered at the depth of submersion of the accumulator. This precharging is necessary to provide a compressible medium that will accept a quantity of power fluid upon charging, and then expell it upon demand.

Upon reaching the operating water depth, the canister is charged with an additional increment of pressure equal to the system differential operating pressure that is required to open or close the valve. This pressure will be roughly equivalent to the pressure required to operate the valve at atmospheric pressure conditions, if the valve were still above the surface of the water.

Unfortunately, should this accumulator not be relieved of operating pressure before its recovery to the surface, extremely high differential pressures between the interior and exterior of the accumulator will result. The accumulator must either be built to with-stand these differential pressures, or the risk of a burst at the surface must be tolerated, with risk of loss to the crew of the surface vessel.

In any event, existing accumulators for deepwater valve activation are typically very bulky, heavy, and provide small working volumes of pressurized fluid. For example, if an accumulator having a volume of 25 gallons were used to activate a valve located in 8000' of water, and the actuator of the valve or other device required at atmospheric pressure a 3000 p.s.i. system operating pressure, only 3 gallons of pressurized hydraulic fluid would be delivered from the 25 gallon accumulator.

A subsea power fluid accumulator therefore is needed that does not present a potential safety hazard to a surface vessel and its crew. This apparatus should also efficiently use pressurized hydraulic fluid accumulated within its boundaries to quickly operate any subsea hydraulically-activated valve assembly.

SUMMARY OF THE INVENTION

The apparatus of the present invention utilizes two separate cylinders containing a moveable piston in each cylinder. The pistons are connected by a rod to each other through appropriate pressure boundary sealing mechanisms. Pressurized hydraulic fluid supplied under the first piston drives the first piston upward. The rod connected between the first and second piston causes the second piston to move upward in the other cylinder.

A vacuum is created under the second piston by its upward movement. Since the other side of the second piston is exposed to the pressure of the sea water, a force is directed downward in the rod attached to the first piston. Proper selection of piston and rod diameters ensures that this downward force is sufficient to force the pressurized hydraulic fluid contained under the first piston into the valve actuator of a nearby hydraulically-activated valve on demand.

The accumulator apparatus of the present invention stores energy due to the evacuation rather than the charging of a chamber. This design results in improved safety to the crew of the vessel since the energy which drives the useful pressurized fluid from the accumulator dissipates as the accumulator is recovered from the depths.

With properly sized pistons this apparatus will also deliver significantly more pressurized hydraulic fluid to the hydraulic valve actuator than that available from a charged canister. It may be noted that the force driving the first piston downward comes from a separate cylinder, and not as in the case of a charged canister, from a pressurized gas carried above the surface of a pressurized fluid.

These and other features, objects, and advantages of the present invention will become apparent from the following detailed description, wherein reference is made to the Figures in the accompanying drawings.

BRIEF DESCRIPTION OF THE DRAWING

FIGS. 2A through 2E are schematic representations of the power fluid accumulator apparatus showing the operating sequence of the apparatus.

DESCRIPTION OF THE PREFERRED EMBODIMENT

Figure 1:
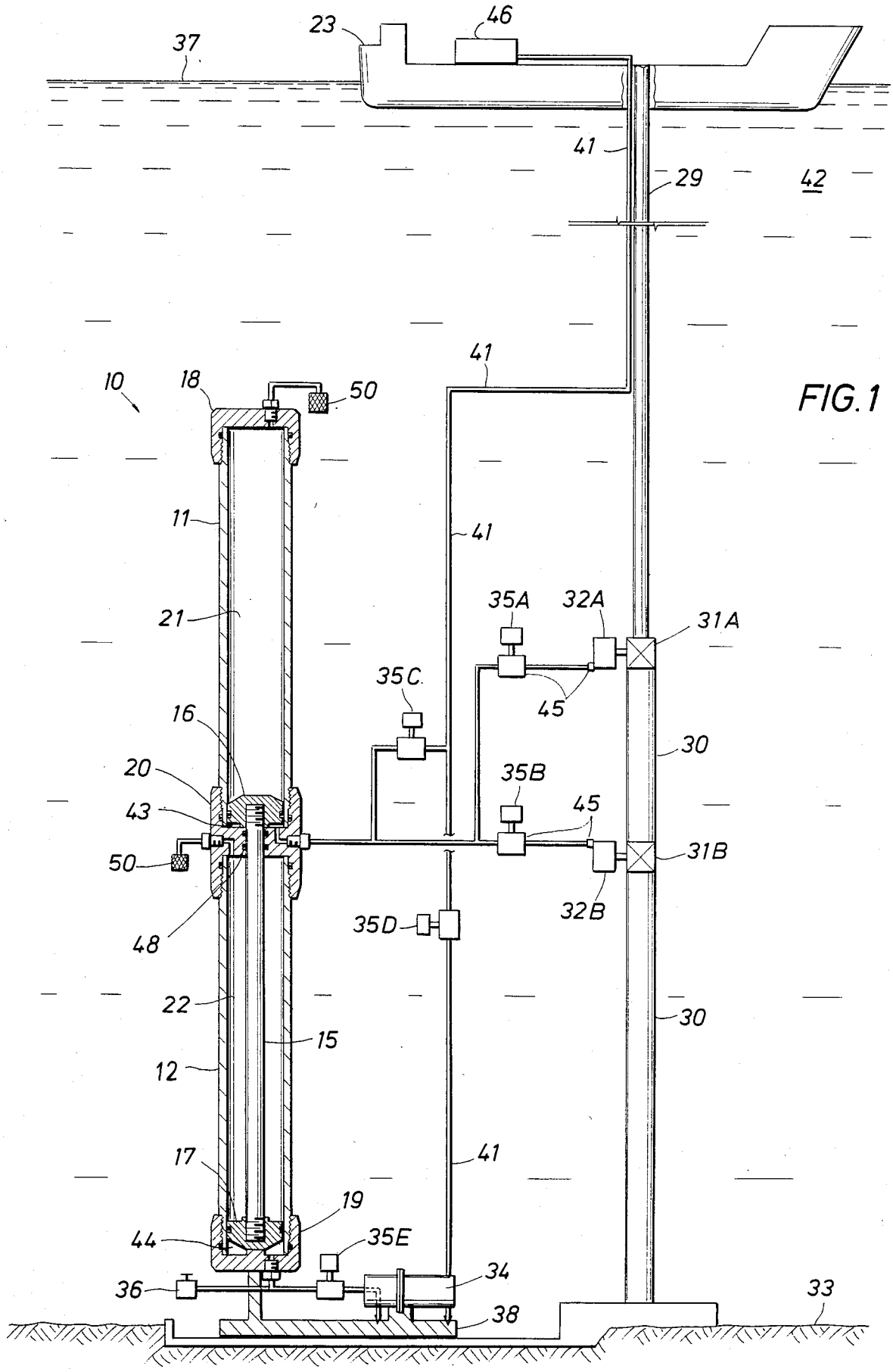
FIG. 1 is a schematic representation of a subsea power fluid accumulator positioned adjacent subsea hydraulically actuated valves.
Figures 2A, 2B, 2C, 2D:
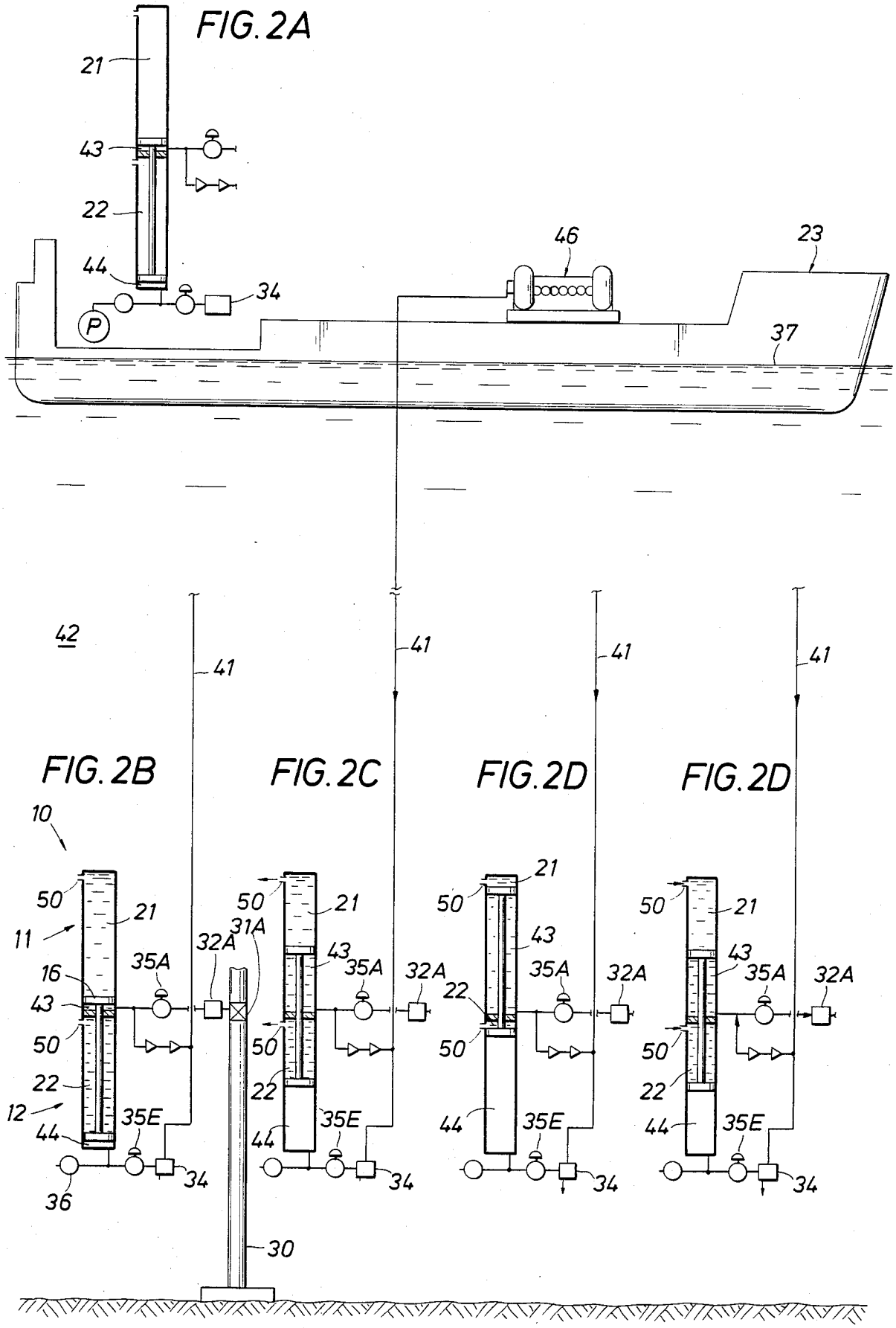

As shown in FIG. 1, a vessel 23 is shown floating upon the surface 37 of a body of water 42. The vessel 23 maybe a dynamically positioned ship, well known to the art, or conversely it may also be a tension leg platform. A typical subsea equipment assembly 30 is schematically shown positioned beneath the vessel 23 and connected to the lower end of a riser 29, which extends downward from the vessel 23. It is recognized that any other subsea equipment assembly 30, having hydraulically actuated valves 31, or other hydraulic operated devices (not shown) such as hydraulic motors or control devices (not shown) may utilize the subsea power fluid accumulator 10 of the present invention.

In the present embodiment the accumulator 10 consist of a first cylinder means 11 positioned above a second cylinder means 12, both cylinders means 11, 12 taking the well recognized form of hydraulic cylinders well known to the art. The cylinders means 11, 12 may also be positioned along side of one another instead of arranged in a tandem fashion. It is recognized that a multiplicity of cylinders 11, 12, suitably connected, could be also used in one assembly. A first moveable piston 16 divides the interior of first cylinder means 11 into a first pressure chamber 21 and a second pressure chamber 43. A second moveable piston 17 divides the interior of the second cylinder means 12 into a first pressure chamber 22 and second pressure chamber 44. Rod means 15, such as a steel shaft well known to the art, connect the first moveable piston 16 with the second moveable piston 17. By this connection, piston 16 remains in the same fixed or spaced relationship with respect to piston 17. Upper cap 18 and lower cap 19 define the upper and lower boundaries of the first cylinder means 11 and second cylinder means 12 respectively. Water ports 50 connected in open fluid communication with first pressure chambers 21, 22 allow the body of water 42 to freely enter each respective pressure chamber 21 and 22 as the subsea power fluid accumulator 10 is submerged beneath the surface 37 of the body of water 42.

Common wall means 20, such as a machined hub or bushing assembly well known to the art, connects the lower end of the first cylinder means 11 to the upper end of the second cylinder means 12. The wall means 20 has an opening carrying seals 48 which allow slideable engagement of the rod means 15 with the seals 48, and also prevents substantial leakage between the first cylinder means 11 and the second cylinder means 12. The outer diameter of piston 16 may vary substantially from the outer diameter of piston 17, depending upon the preferred depth of operation for the subsea power fluid accumulator 10. In this manner the force balance required along the rod means 15 may be adjusted to insure proper operation of the accumulator 10 at various depths in the body of water 42.

A pressurized fluid source means 46, such as a positive displacement pump well known to the art, is shown carried by the vessel 23. In the preferred embodiment, this pressurized fluid source means 46 is shown connected to the first cylinder means 11 second pressure chamber 43, though it is recognized that it may alternatively be connected to the second cylinder means 12 second pressure chamber 44 with suitable changes in ports 50 and fluid flow. Hydraulic fluid supplied by this pressurized fluids source means 46 is carried downwardly through a hydraulic fluid line 41 from the surface vessel 23 to the subsea power fluid accumulator 10 connected to underwater apparatus 30.

Hydraulic fluid connection means 45 consisting of control valves means 35A, B, well known to the art, and other fittings needed to connect to typical valve actuators 32A, B on an underwater installation, are shown connected between the valve actuators 32A, B and the second pressure chamber 43 of the first cylinder means 11.

Hydraulic fluid connection means 45 may be connected to more than one valve actuator 32A or 32B in order to allow actuation of different hydraulically actuated valves 31A, 31B, or other subsea devices as is well known to the art. Other control valve means 35D also direct the hydraulic fluids supplied by the pressurized-fluid source means 46 through the hydraulic fluid line 41 to supply power to the evacuation pump 34. In the preferred embodiment, the pump 34 is connected through control valve means 35E to the second pressure chamber 44 of the second cylinder means 12, such that the evacuation pump 34 may periodically or continuously remove any fluid from the second pressure chamber 44 when actuated, in order to create or sustain a vacuum underneath the second moveable piston 17. This will facilitate effective operation of the accumulator despite slight leakage of fluid past the pistons 16, 17 over long periods. A valve 36 may be used to manually drain at the surface any fluid from the second pressure chamber 44 prior to activation of the evacuation pump 34. The evacuation pump 34 is carried by a support base 38 which may be connected between the subsea equipment assembly 30 and at least one of the cylinder means 11, 12, Each valve actuator 32 typically utilizes a piston or diaphragm (not shown) connected to a gate or ball (not shown) contained within the hydraulically-actuated valve 31. Each piston or diaphragm is typically held in a favored position by a spring mechanism (not shown) in order to allow the valve to fail in one particular position. To operate a typical valve actuator 32, pressurized fluid supplied by hydraulic fluid connection means 45 overcomes the spring force of the spring carried by the actuator 32, thereby causing the gate or ball of a hydraulically-actuated valve 31 to change from a open or closed position to an alternate position. A typical hydraulically-actuated valve 31 may take the form, for example, of a 18 ¾" 10,000 psi Cameron Ram Blowout Preventor manufactured by Cameron Iron Works of Houston, Tex.

Referring now to FIGS. 1, and 2A through 2E, the operating sequence of the subsea power fluid accumulator apparatus 10 may be seen. The accumulator 10 and at least one hydraulically actuated valve 31 are initially carried by the vessel 23. The accumulator apparatus 10 is connected to the hydraulic actuator 32 of a hydraulically actuated valve 31 by the hydraulic fluid connection means 45. At some point during this connection process the evacuation pump 34 is actuated to evacuate any fluid from the second pressure chamber 44. This permits the creation of as strong a vacuum as possible within the second pressure chamber 44 when the second moveable piston 17 is moved upward within the second cylinder means 12 during the subsequent submerged operation of the accumulator 10. The pressurized fluid source means 46 may be placed in fluid communication with the evacuation pump 34 by means well known to the art during the operation at the surface, or submerged, or an auxiliary source of power (not shown) may also be used to evacuate the second pressure chamber 44.

The accumulator apparatus 10 with the attached hydraulic actuator 32 of the hydraulically actuated valve 31 is then lowered downwardly through the body of water 42 until the hydraulically actuated valve 31 becomes a part of a particular subsea equipment assembly 30. During this submersion of the accumulator apparatus 10 the first cylinder 11 with its first pressure chamber 21 and the second cylinder 12 with its first pressure chamber 22 are placed in open fluid communication with the body of water 42, thereby allowing water to freely flood the upper chambers 21, 22 of both cylinders means 11, 12. This allows the pressure within both first pressure chambers 21, 22 to become equalized with the particular pressure of the body of water 42 at a particular submersion depth. If the apparatus 10 is submerged in saltwater, the pressure of the saltwater at a particular depth may be found by multiplication of the depth (in feet) by 0.445 p.s.i./ft.

Once the accumulator 10 and associated hydraulically actuated valve 31 are positioned at the desired operating depth the pressurized fluid source means 46 (FIG. 1) is actuated and the accumulator 10 is charged with high pressure fluid through hydraulic fluid line 41 and control valve means 35C.

After the charging operation, when rapid operation of valve 31 is desired, valve 31 is actuated by operating the control valve means 35 forming a portion of the hydraulic fluid connection means 45. These actions selectively direct pressurized fluid through the hydraulic fluid connections means 45 to a hydraulic actuator 32 of a hydraulically actuated valve 31. The pressurized fluid source means 46 supplies a small amount of pressurized fluid at a low rate (not shown) to the second pressure chamber 43 of the first cylinder means 11 from the surface, but the bulk of fluid to operate valve 31 rapidly is furnished from accumulator 10.

During the charging operation it is recognized that this pressurized fluid can also be delivered to the second pressure chamber 44. The accumulator 10 of the present invention will operate properly if the fluid connection means 45 and the pressurized fluid are placed in fluid communication with the same second pressure chamber 43 or 44, and the evacuation pump 34 is connected to the opposite second pressure chamber 44 or 43 respectively.

In other words, in the preferred embodiment the second pressure chamber 43 was selected to have pressurized fluid supplied to it, and second pressure chamber 44 was selected to have a vacuum created in it.

Supplying pressurized fluid beneath the first moveable piston 16 drives this piston 16 upward, along with the rod means 15 and the attached second moveable piston 17. The upward movement of the second moveable piston 17 creates a vacuum in the other second pressure chamber 44. Both pistons 16 and 17 may stroke to the upper end of their respective cylinders means 11 and 12 at this time. Water 42 is freely expelled from chambers 21, 22. The pressurized fluids supplied to the second pressure chamber 43 can be maintained at a predetermined pressure by continuously energizing the pressurized fluid source means 46 located upon the vessel 23, after or during periods of power fluid usage from accumulator 10. The value of this predetermined pressure can be readily determined by summation of the pressure of the water at the particular operating depth of the apparatus 10 with the pressure required for proper system operation of each respective vessel activator 32. For example, at a depth of 6,000 feet this predetermined pressure may approximate 8,000 psi.

Once the second pressure chamber 43 is fully charged the control valve means 35 or 35B located between the first cylinder means 11 second chamber 43 and a hydraulically actuated valve 31 valve actuator 32 will be opened, thereby placing the valve actuator 32 in direct fluid communication with the pressurized second pressure chamber 43. The pressurized fluid source means 46 may be continuously operated during this sequence of the operation in order to supplied additional pressurized fluid to each respective valve actuator 32. The influx of this fluid from the second pressure chamber 43 to the face of the piston (not shown) or diaphragm (not shown) carried within each respective valve actuator 32 will cause the valve actuator 32 to open or close the respective hydraulically actuated valve 31. During the pressurization of the second pressure chamber 43 and subsequent upward movement of the first moveable piston 16 and second moveable piston 17, a near absolute vacuum is naturally formed underneath the second moveable piston 17. Unless substantial leakage occurs this near vacuum may be maintained without continued operation of the evacuation pump 34. Small amounts of leakage will not seriously reduce the power fluid delivery capacity since the fluid will accumulate near the bottom of chamber 44, and not impede a near full downward stroke during fluid delivery. Operation of this pump 34 will aid in the removal of any substantial leakage of water 42 around the outside diameter of the second moveable piston 17.

Specifically, the subsea power-fluid accumulator apparatus which is adapted to activate a hydraulically activated valve located in a body of water comprises first cylinder means including a first moveable piston dividing said first cylinder means into an upper first pressure chamber and a lower second pressure chamber, said first chamber connectable in fluid communication with said body of water, second cylinder means including a second moveable piston dividing said second cylinder means into an upper first pressure chamber and a lower second pressure chamber, said first chamber connectable in fluid communication with said body of water, rod means fixedly connectable between said first piston and said second piston, pressurized fluid source means connectable in fluid communication with one of said second pressure chambers, and hydraulic fluid connection means operatively connectable between said second pressure chamber connected in fluid communication with said pressurized fluid source means, and said hydraulically-operated valve.

Many other variations and modifications may be made in the apparatus and techniques hereinbefore described by those having experience in this technology, without departing from the concept of the present invention. Accordingly it should be clearly understood that the apparatus and methods depicted in the accompanying drawings and referred to in the foregoing description are illustrative only and not intended as limitations on the scope of the invention.

I claim as my invention:

1. A subsea power fluid accumulator apparatus adapted to actuate hydraulically-actuated devices, such as a hydraulically-actuated valve, said valve locatable beneath a surface of a body of water, said apparatus comprising:

first cylinder means including a first moveable piston capable of dividing said first cylinder means into an upper first pressure chamber and a lower second pressure chamber, said first cylinder means having a water port defined therethrough placing said first pressure chamber in open fluid communication with said body of water, to allow the pressure within said first pressure chamber to become equalized with the pressure of said body of water at a particular submersion depth, second cylinder means including a second moveable piston capable of dividing said second cylinder means into an upper first pressure chamber and a lower second pressure chamber, said second cylinder means having a water port defined therethrough placing said first pressure chamber in open fluid communication with said body of water, to allow the pressure within said first pressure chamber to become equalized with the pressure of said body of water at a particular submersion depth, rod means fixedly connectable between said first piston and said second piston, pressurized fluid source means connectable in fluid communication with one of said second pressure chambers, and hydraulic fluid connection means operatively connectable between said one of said second pressure chambers and said hydraulically operated valve.

2. The apparatus of claim 1 further including common wall means, forming a common dividing wall between said first cylinder means second pressure chamber and said second cylinder means first pressure chamber when said cylinder means are assembled, said common wall means including seals defining an opening therethrough, said rod means slideably engaged with said seals when assembled through said common wall means to permit upward and downward movement of said rod means relative to said seals said seals preventing substantial leakage between said first pressure chamber and said second pressure chamber.

3. The apparatus of claim 1 further including evacuation pump means connectable in fluid communication with the other of said second pressure chambers.

4. The apparatus of claim 3 wherein said evacuation pump means is powerable by said pressurized fluid source means, to evacuate the other of said second pressure chambers.

5. A subsea power fluid accumulator apparatus for use in actuation of a hydraulically actuated valve located beneath a surface of a body of water, said apparatus comprising:

first cylinder means including a first moveable piston dividing said first cylinder means into an upper first pressure chamber and a lower second pressure chamber, said first cylinder means having a water port defined therethrough placing said first pressure chamber in open fluid communication with said body of water, to allow the pressure within said first pressure chamber to become equalized with the pressure of said body of water at a particular submersion depth, second cylinder means including a second moveable piston dividing said second cylinder means into an upper first pressure chamber and a lower second pressure chamber, said second cylinder means having a water port defined therethrough placing said first pressure chamber in open fluid communication with said body of water, to allow the pressure within said first pressure chamber to become equalized with the pressure of said body of water at a particular submersion depth, rod means fixedly connected between said first piston and said second piston, pressurized fluid source means, connected in fluid communication with one of said second pressure chambers, and hydraulic fluid connection means operatively connected between said one of said second pressure chambers and said hydraulically-actuated valve.

6. The apparatus of claim 5 wherein said pressurized fluid source means is carried by a vessel floating upon the surface of said body of water, said vessel being located substantially above said hydraulically-actuated valve.

7. The apparatus of claim 5 further including evacuation pump means operatively connected to a portion of said subsea power fluid accumulator apparatus, said evacuation pump means placed in open fluid communication with the other of said second pressure chambers.

8. The apparatus of claim 7 wherein said evacuation pump means is powerable by said pressurized fluid source means, to evacuate the other of said second pressure chambers.

9. The apparatus of claim 5 further including common wall means, forming a common dividing wall between said first cylinder means second pressure chamber and said second cylinder means first pressure chamber, said common wall means including seals defining an opening therethrough, said rod means slideably engaged with said seals to permit upward and downward movement of said rod means relative to said seals said seals preventing substantial leakage between said first pressure chamber and said second pressure chamber.

10. A subsea power fluid accumulator apparatus for use in actuation of a hydraulically actuated valve located beneath a surface of a body of water, said apparatus comprising:

first cylinder means including a first moveable piston dividing said first cylinder means into an upper first pressure chamber and a lower second pressure chamber, said first cylinder means having a water port defined therethrough placing said first pressure chamber in open fluid communication with said body of water, to allow the pressure within said first pressure chamber to become equalized with the pressure of said body of water at a particular submersion depth, second cylinder means including a second moveable piston dividing said second cylinder means into an upper first pressure chamber and a lower second pressure chamber, said second cylinder means having a water port defined therethrough placing said first pressure chamber in open fluid communication with said body of water, to allow the pressure within said first pressure chamber to become equalized with the pressure of said body of water at a particular submersion depth, rod means fixedly connected between said first piston and said second piston, pressurized fluid source means, connected in fluid communication with one of said second pressure chambers, hydraulic fluid connection means operatively connected between said one of said second pressure chambers and said hydraulically-actuated valve, and evacuation pump means operatively connected to a portion of said subsea power fluid accumulator apparatus, said evacuation pump means placed in open fluid communication with the other of said second pressure chambers.

* * * * *